US006045982A

United States Patent [19]

Cloutier

[11] Patent Number: 6,045,982

[45] Date of Patent: Apr. 4, 2000

[54] FILM LEADER

[75] Inventor: Robert P. Cloutier, Spencerport, N.Y.

[73] Assignee: Eastman Kodak Company, Rochester, N.Y.

[21] Appl. No.: 09/210,501

[22] Filed: Dec. 11, 1998

[51] Int. Cl.[7] ..... G03C 3/00; G03C 3/02

[52] U.S. Cl. ..... 430/501; 430/496; 242/348.4; 206/316.1; 206/395; 206/410

[58] Field of Search ..... 430/501, 496; 242/348.4; 206/316.1, 395, 410

[56] References Cited

U.S. PATENT DOCUMENTS

| | | | |
|---|---|---|---|
| 1,332,890 | 3/1920 | Fallesen et al. | 430/501 |
| 1,441,146 | 1/1923 | Eastman | 430/501 |
| 1,991,442 | 2/1935 | Barenyi | 430/501 |
| 5,205,506 | 4/1993 | Mizuno et al. | 242/71 |
| 5,286,614 | 2/1994 | Ishizaki et al. | 430/501 |

FOREIGN PATENT DOCUMENTS

| | | | |
|---|---|---|---|
| 2001452 | 1/1979 | United Kingdom | G03C 3/00 |

*Primary Examiner*—Mark F. Huff
*Attorney, Agent, or Firm*—Roger A. Fields

[57] ABSTRACT

A film leader comprising a main leader portion having a pair of parallel straight edges between which the main leader portion has a constant width, an extreme end portion extending from the main leader portion and having a pair of longitudinal edges between which the extreme end portion only has a width that is smaller than the width of the main leader portion; and a weakened fold-line, is characterized in that the weakened fold-line completely divides the main leader portion and the extreme end portion and is uniformly inclined from one of the parallel straight edges of the main leader portion to the other parallel straight edge of the main leader portion to thus form a forward-most inclined straight edge of the main leader portion when the extreme end portion is folded totally onto the main leader portion along the fold-line.

2 Claims, 3 Drawing Sheets

FILM LEADER

FIELD OF THE INVENTION

The invention relates generally to the field of photography, and in particular to a film leader for a filmstrip which may be integral with or attached to the filmstrip. When attached to the filmstrip, the film leader typically is made of a different material than the filmstrip, such as paper. Otherwise the film leader is an integral longitudinal end portion of the filmstrip.

BACKGROUND OF THE INVENTION

Prior art U.S. Pat. No. 1,441,146 issued Jan. 2, 1923 discloses a film leader in the known form of a protective backing paper for a filmstrip stored on a flanged film spool. The film leader comprises a main leader portion having a pair of parallel straight edges between which the main leader portion has a constant width, and an extreme end portion extending from the main leader portion and having a pair of similarly tapered (converging) edges between which the extreme end portion has a gradually reducing width that is smaller than the width of the main leader portion. The extreme end portion is significantly shorter than the main leader portion. A non-inclined weakened fold-line longitudinally extends from one of the tapered edges of the extreme end portion to the other tapered edge of the extreme end portion to thus form a forward-most non-inclined straight edge of the extreme end portion when approximately a forward-most half of the extreme end portion is folded, along the fold-line, onto the remaining half of the extreme end portion. This is illustrated in FIG. 1 of the drawings, designated as "PRIOR ART", in this application. In FIG. 1, there is shown the film leader 10, the main leader portion 12, the pair of parallel straight edges 14 and 16, the constant width 18, the extreme end portion 20, the two tapered edges 22 and 24, the gradually reducing width 26, the fold-line 28, the forward-most non-inclined straight edge 30, the forward-most half 32, the remaining half 34, and the flanged film spool 36. The forward-most half 32 of the extreme end portion 20 is depicted in solid lines before being folded, along the fold-line 28, onto the remaining half 34 of the extreme end portion and in broken lines when folded onto the remaining half 34 of the extreme end portion.

The known ADVANCED Photo System™ introduced several years ago, includes a film leader that is an integral longitudinal end portion of a filmstrip stored inside a film cartridge. The film leader has a forward-most straight edge which substantially is uniformly inclined from one of the parallel straight edges of the film leader to the other parallel straight edge of the film leader. This is illustrated in FIG. 2 of the drawings, designated as "PRIOR ART", in this application. In FIG. 2, there is shown the film leader 40, the forward-most straight edge 42, the pair of parallel straight edges 44 and 46, and the film cartridge 48.

SUMMARY OF THE INVENTION

A film leader comprising a main leader portion having a pair of parallel straight edges between which the main leader portion has a constant width, an extreme end portion extending from the main leader portion and having a pair of longitudinal edges between which the extreme end portion only has a width that is smaller than the width of the main leader portion; and a weakened fold-line, is characterized in that:

the weakened fold-line completely divides the main leader portion and the extreme end portion and is uniformly inclined from one of the parallel straight edges of the main leader portion to the other parallel straight edge of the main leader portion to thus form a forward-most inclined straight edge of the main leader portion when the extreme end portion is folded totally onto the main leader portion along the fold-line.

DETAILED DESCRIPTION OF THE INVENTION

The invention is disclosed as being embodied preferably in a film leader for a filmstrip. Because the features of a film leader are generally known, the description which follows is directed in particular only to those elements forming part of or cooperating directly with the disclosed embodiment. It is to be understood, however, that other elements may take various forms known to a person of ordinary skill in the art.

Figure 1:
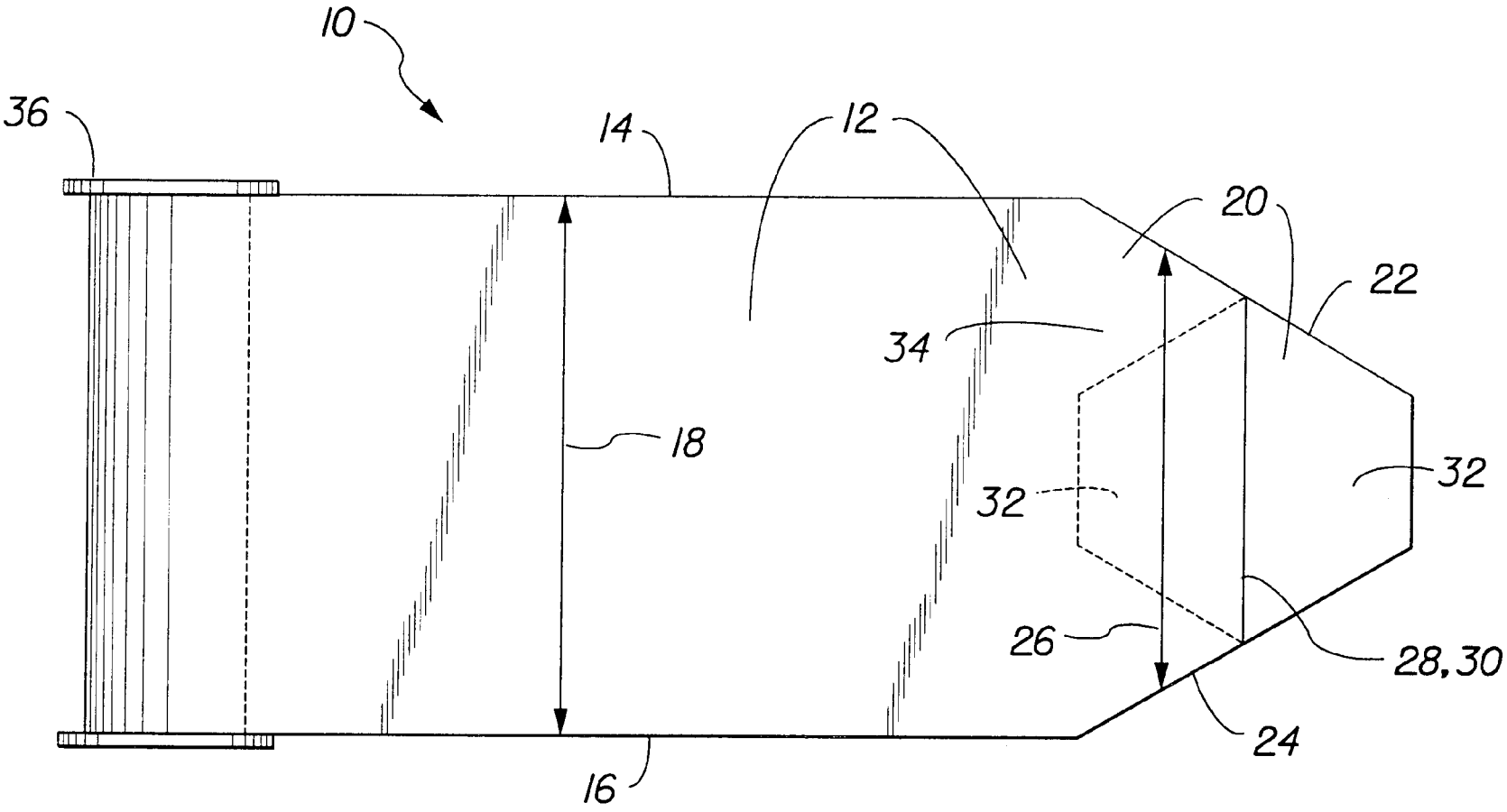
FIG. 1 (PRIOR ART)
FIG. 1 is an elevation view of the prior art film leader disclosed in U.S. Pat. No. 1,441,146.
Figure 2:
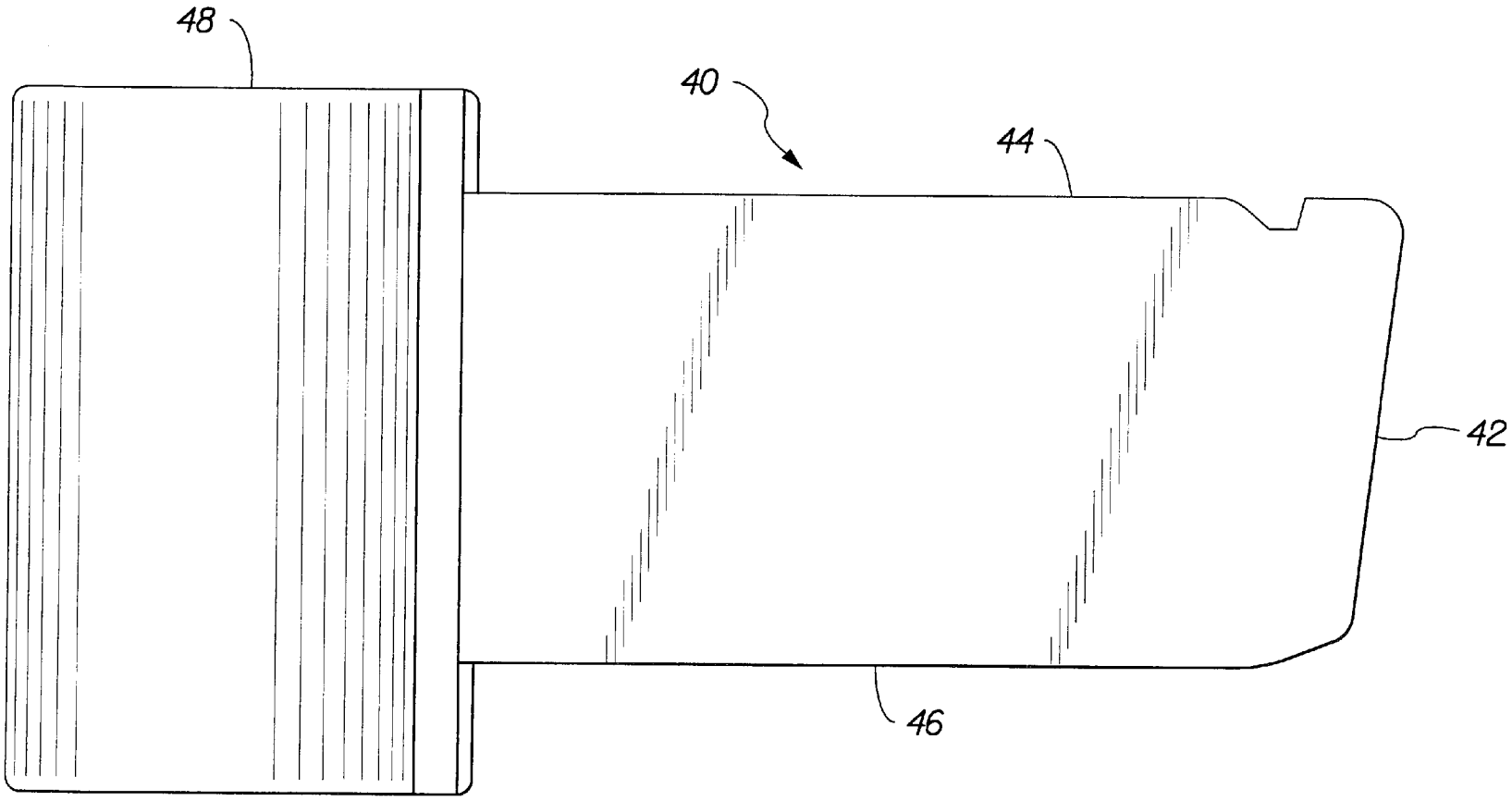
FIG. 2 (PRIOR ART)
FIG. 2 is an elevation view of the prior art ADVANCED Photo System™ film leader.
Figure 3:
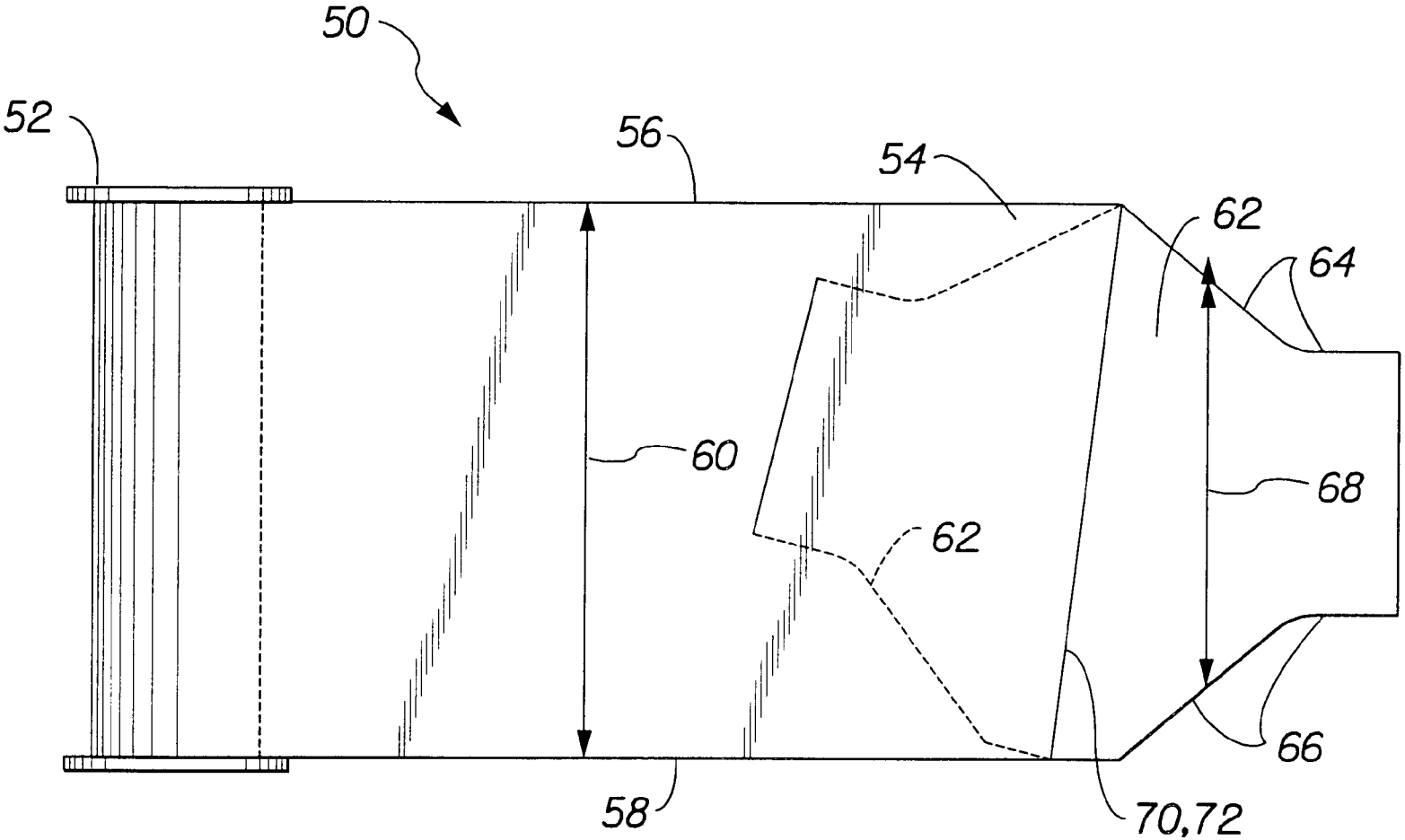
FIG. 3 is an elevation view of a film leader according to a preferred embodiment of the invention.

Referring now to the drawings, FIG. 3 shows a film leader 50 in the form of a protective backing paper for a filmstrip stored on a flanged film spool 52. The film leader 50 comprises a main leader portion 54 having a pair of parallel straight edges 56 and 58 between which the main leader portion has a constant (non-changing) width 60, an extreme end portion 62 extending from the main leader portion and having a pair of longitudinal edges 64 and 66 between which the extreme end portion has a changing width 68 that is always smaller than the width of the main leader portion; and a weakened fold-line 70.

The main leader portion 54 is significantly longer than the extreme end portion 62.

The weakened fold-line 70 completely divides the main leader portion 54 and the extreme end portion 62 and is uniformly inclined from one of the parallel straight edges 56 of the main leader portion to the other parallel straight edge 58 of the main leader portion to thus form a forward-most inclined straight edge 72 of the main leader portion when the extreme end portion is folded totally onto the main leader portion along the fold-line. In FIG. 3, the extreme end portion 62 is depicted in solid lines before being folded onto the main leader portion 54 along the fold-line 70 and in broken lines when folded onto the main leader portion.

The film leader 50 can be used with the extreme end portion 62 not folded onto the main leader portion 54. In this instance, the extreme end portion 62 is intended to be inserted into a slot in the spool core of a known film spool, as in prior art U.S. Pat. No. 1,441,146, to secure the extreme end portion to the spool core preparatory to winding the film leader 50 (and the filmstrip) onto the spool core.

Alternatively, the film leader 50 can be used with the extreme end portion 62 folded onto the main leader portion 54 along the fold-line 70. In this instance, the film leader 50 is advanced or thrust with the forward-most inclined straight edge 72 of the main leader portion 54 serving as a leading edge. The fact that the forward-most straight edge 72 is inclined facilitates advance or thrust of the film leader.

The invention has been described with reference to a preferred embodiment. However, it will be appreciated that variations and modifications can be effected by a person of ordinary skill in the art without departing from the scope of the invention. For example, the fold-line 70 can be perforated to permit the extreme end portion 62 to be readily separated from the main leader portion 54 rather than having to fold the extreme end portion onto the main leader portion. A lightly applied tacky substance can be located on the extreme end portion 62 to maintain the extreme end portion folded onto the main leader portion 54.

PARTS LIST

10. film leader
12. main leader portion
14. parallel straight edge
16. parallel straight edge
18. constant width
20. extreme end portion
22. tapered edge
24. tapered edge
26. gradually reducing width
28. fold-line
30. non-inclined straight edge
32. forward-most half
34. remaining half
36. film spool
40. film leader
42. forward-most inclined straight edge
44. parallel straight edge
46. parallel straight edge
48. film cartridge
50. film leader
52. film spool
54. main leader portion
56. parallel straight edge
58. parallel straightedge
60. constant width
62. extreme end portion
64. longitudinal edge
66. longitudinal edge
68. changing width
70. fold-line
72. forward-most inclined straight edge

What is claimed is:

1. A film leader comprising a main leader portion having a pair of parallel straight edges between which said main leader portion has a constant width, an extreme end portion extending from said main leader portion and having a pair of longitudinal edges between which said extreme end portion only has a width that is smaller than the width of said main leader portion; and a weakened fold-line, is characterized in that:

said weakened fold-line completely divides said main leader portion and said extreme end portion and is uniformly inclined from one of said parallel straight edges of the main leader portion to the other parallel straight edge of the main leader portion to thus form a forward-most inclined straight edge of said main leader portion when said extreme end portion is folded totally onto said main leader portion along said fold-line.

2. A film leader as recited in claim 1, wherein said fold-line is perforated to permit said extreme end portion to be readily separated from said main leader portion.

* * * * *